United States Patent [19]

Lis et al.

[11] 4,213,405

[45] Jul. 22, 1980

[54] WATER-COOLED GRATE

[75] Inventors: Per-Arne Lis; Karl A. Olausson, both of Järfälla, Sweden

[73] Assignee: Gotaverken Anteknik AB, Goteborg, Sweden

[21] Appl. No.: 937,176

[22] Filed: Aug. 28, 1978

[30] Foreign Application Priority Data

Sep. 5, 1977 [SE] Sweden ..... 7709940

[51] Int. Cl.[2] ..... F23G 5/00

[52] U.S. Cl. ..... 110/234; 110/225; 110/165 R; 122/2

[58] Field of Search ..... 122/2; 110/225, 204, 110/234, 273, 267, 327, 165 R

[56] References Cited

U.S. PATENT DOCUMENTS

| | | | |
|---|---|---|---|
| 2,033,685 | 3/1936 | Coutant | 110/234 |
| 2,269,273 | 1/1942 | Krogh et al. | 110/225 |
| 2,875,735 | 3/1959 | Falla | 110/234 |
| 3,332,375 | 7/1967 | Ito | 110/225 |
| 3,926,130 | 12/1975 | Stloukel et al. | 110/234 |

*Primary Examiner*—Edward G. Favors

*Attorney, Agent, or Firm*—Schuyler, Birch, McKie & Beckett

[57] ABSTRACT

A furnace for the combustion of solid fuel is disclosed comprising two juxtaposed grate portions and a passageway for conducting combustion gases from the area above one grate portion to the fuel contained on the other grate portion. One grate portion is steeply inclined, and the other is spaced therefrom and has a facing first, mainly upright part and a second, mainly horizontal part extending backwards below the first grate portion to receive fuel residues therefrom. The combustion gases are conducted from the second, mainly horizontal part of the second grate portion to the upper part of the first grate portion.

6 Claims, 1 Drawing Figure

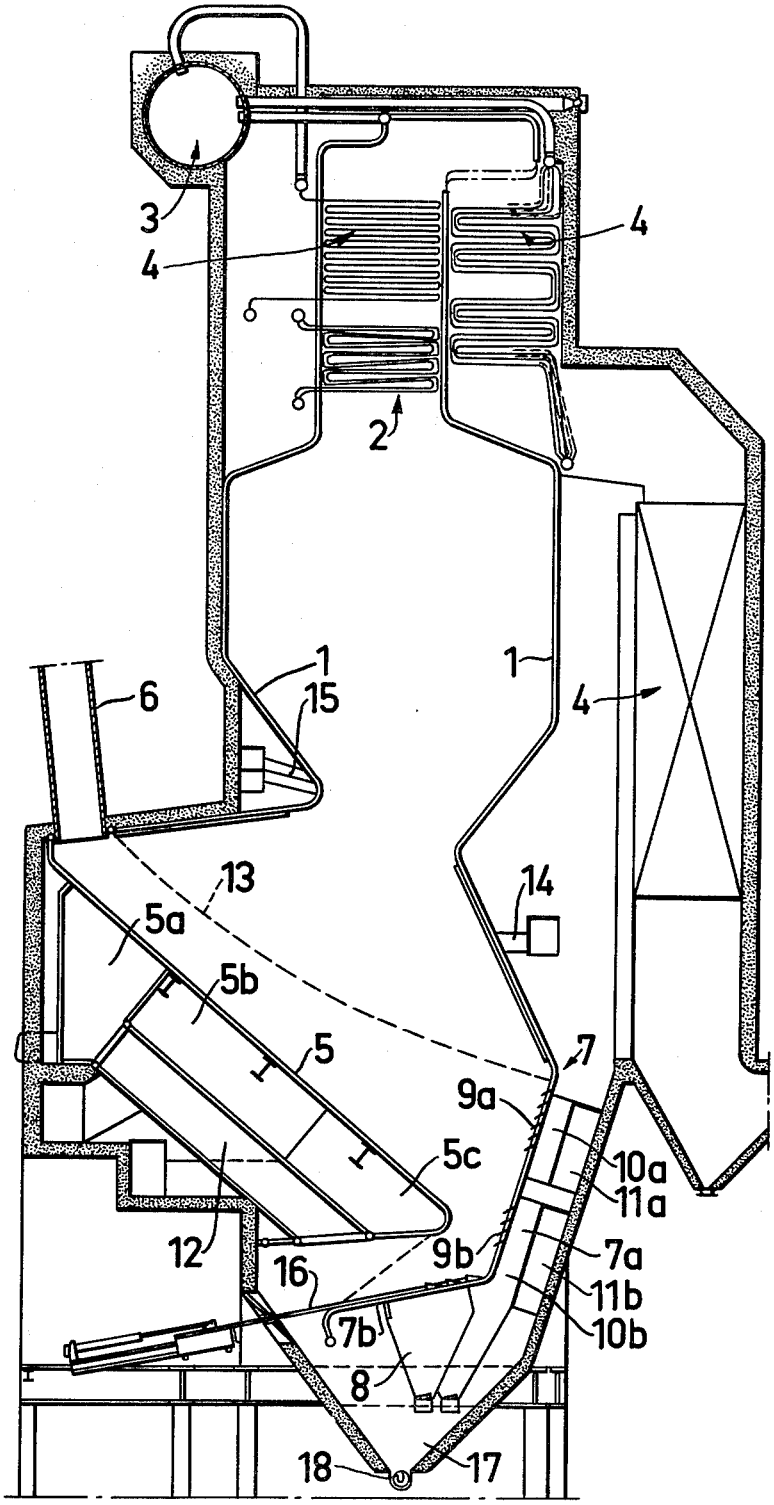
3
4
4
2
1
1
6
15
4
13
14
5a
5b
5
7
9a
5c
10a
11a
12
16
9b
7a
11b
7b
10b
8
18
17

WATER-COOLED GRATE

This invention relates to a water-cooled grate at installations for the combustion of primarily wood fuel, bark, peat or the like.

The object of the invention is to bring about a combustion of wood fuels, a.o. wood waste, with improved fuel economy and lower dust emission and at the same time with increased flexibility compared with the known conventional combustion.

This object is achieved by the present invention thereby that it has been given the characterizing features set forth in the attached claims.

Owing to the invention, a pyrolysis and combustion process takes place to the depth of the fuel bed. Ashes, slag and heavy particles work themselves downward in the bed, and the amount of fly dust is reduced. The combustion takes place with low excess air, because the air is supplied under control on different levels in the grate, and the combustion to a great part is completed in the zone above the second grate portion. The return flow of hot flue gases from this zone to the upper forward portion of the first grate portion results in a good drying of the fuel. Due to the fact that the first drying zone now is supplied with hot flue gases instead of with hot air, which normally is supplied, the amount of infiltrated air, which normally comes primarily from said zone, is reduced substantially, so that the excess air will be lower than at previous constructions with air in the first drying zone. Owing to the grate design according to the invention, the fuel layer will be thick, so that there always is a great amount of dried fuel on the grate. This implies that the combustion reacts immediately on an increase in air supply, which in its turn implies the possibility of a substantially enhanced flexibility of the operation.

The invention is described in greater detail in the following by way of an embodiment and with reference to the accompanying drawing showing schematically a boiler provided with the grate according to the invention.

The steam boiler will not be described in detail, because it may, as indicated, be of some current type or be a hot-water boiler. 1 designates the tubes enclosing the combustion space, 2 designates a heat exchanger, 3 designates a steam dome and 4 designates one or more heat exchangers.

The boiler grate according to the invention comprises a first grate portion 5, which may be of conventional design. The grate portion 5 is arranged steeply inclined and is fed with fuel from above via the charge pipe 6, which may have conventional design and function. The inclination of the grate portion 5 shall exceed the angle of repose of the fuel.

The grate according to the invention further is formed with a second grate portion 7, a part 7*a* of which extends upward at a certain distance from the lower end of the first grate portion 5, and a second part 7*b* of which extends inward below the first grate portion 5. Said part 7*b* forms a final combustion grate and is provided in a usual manner with air gaps (not shown), to which combustion air is supplied from the pocket 8. The part 7*a* of the grate portion 7 is provided with apertures in an upper zone 9*a* and in a lower zone 9*b*, which are supplied with combustion air each from a pocket 10*a* and, respectively, 10*b*. The combustion air, which is passed separately adjustably to the respective pocket 10*a*, 10*b* from the inlets 11*a*,11*b*, consists in usual manner of air preheated, for example, to 160° C.

The first inclined grate portion 5 is divided into three zones 5*a*,5*b*,5*c*. The zone 5*a* is supplied with hot combustion gas from the final combustion zone over part 7*b* of the grate portion 7. The gases from said final combustion zone are passed to zone 5*a* through a water-cooled panel-shaped gas passageway 12. The zone 5*b* is supplied with air preheated to a temperature of about 240° C., and the zone 5*c* is supplied with air preheated to a temperature of about 160° C. The air is passed to the respective zone 5*b* and 5*c* in a way common in this technical field and not shown here.

The fuel fills the combustion space to a level indicated by 13 and covers substantially the entire upwardly directed part 7*a* of the second grate portion 7. By passing combustion gas from the final combustion zone over the grate part 7*b* all the way to the charging end of the grate portion 5 (5*a*), it is possible to efficiently pre-dry the fuel. This takes place with excess air of a smaller amount than heretofore possible. As there always is a great amount of fuel on the grate, the combustion immediately is influenced by an increase or a decrease in the supply of combustion air, which implies the possibility of rapid operation control.

This is further achieved by adjustably supplying air to the bed in the zones 5*b* and 5*c* and where the bed is thickest, i.e. through the part 7*a* of the grate portion 7 in two zones 9*a*, 9*b* fed independently of each other.

The boiler shown in the Figure is provided with a secondary air system indicated by 14, which has the object of supplying combustion air in the area above the fuel surface 13 where pyrolysis gas is to be finally combusted. A tertiary air system indicated by 15 has the object of supplying air at high speed, implying a good final mixture of air and combustible gases. The passageway is compressed in order to facilitate said mixing. The air supplied to the grate and to the different areas can be controlled and measured by means of dampers and measuring devices (not shown) for the respective area.

Owing to the design of the invention as described above and defined in the attached claims, the following advantages can be obtained:

reduced dust emission from the boiler low excess air improved firing economy compared with a known installation of corresponding size greater operation flexibility.

The part 7*b* of the grate portion 7 is provided with scraper means 16 for removing ashes from the boiler, which scraper means may be of known type. Ashes possibly dropping through the grate into the pockets 8 and 10 are collected in the space 17, from which the ashes are discharged, for example by a screw conveyor 18.

The air apertures arranged in the respective grate portion are shielded off in a suitable way by inclined metal sheets (not shown) in order to prevent the fuel from penetrating out through the apertures.

What we claim is:

1. A furnace for the combustion of solid fuel comprising:

a first, inclined grate portion having an upper end and a lower end, the upper end adjacent to a side wall defining the furnace, said first grate portion extending outwardly below a combustion space;

means for supplying fuel to the upper end of said inclined, first grate portion;

an angular, second grate portion spaced apart from the lower end of said first grate portion and comprising a first, mainly upright part facing said first grate portion, and a second, mainly horizontal part extending backwards, below said first grate portion to receive fuel residues therefrom;

means for supplying combustion air to said first and said second grate portions; and a passageway for conducting combustion gases from said second part of said second portion to the upper end of said first grate portion.

2. A furnace according to claim 1 further comprising at least two air supply zones located one above the other along the first upright part of said second grate portion, and means for independently feeding combustion air to each of said zones.

3. A furnace according to claim 1 further comprising at least two air supply zones located serially along said first grate portion downstream of the upper end thereof and downstream of the zone of introducing of combustion gases from said second part of said second grate portion, and means for independently feeding combustion air to each of said zones.

4. A furnace according to claim 3 wherein said means for feeding combustion air to each of said zones supplies hotter air to the upstream zone than to the downstream zone.

5. A furnace according to claim 1 wherein said gas passageway is a water-filled channel.

6. A furnace according to claim 1 wherein said first grate portion is inclined more steeply than the angle of repose of the fuel.

* * * * *